US006094877A

United States Patent [19]

White

[11] Patent Number: 6,094,877

[45] Date of Patent: Aug. 1, 2000

[54] FRAME SUPPORT ASSEMBLY AND METHOD FOR CURVED WALLS

[76] Inventor: Charles L. White, 15 Vindel La., Napa, Calif. 94558

[21] Appl. No.: 09/139,160

[22] Filed: Aug. 24, 1998

[51] Int. Cl.[7] ..... E04B 1/32; E04G 11/04

[52] U.S. Cl. ..... 52/247; 52/86; 52/245; 52/631; 52/745.07

[58] Field of Search ..... 52/741.13, 745.07, 52/745.05, 245, 247, 86, 631, 85, 87, 417, 241, 243, 630, 244, 169.7, 248

[56] References Cited

U.S. PATENT DOCUMENTS

| | | | |
|---|---|---|---|
| 3,317,927 | 5/1967 | Shields . | |
| 3,428,969 | 2/1969 | Diamond et al. . | |
| 4,055,922 | 11/1977 | Ellington et al. | 52/169.7 |
| 5,155,872 | 10/1992 | Aymes | 52/247 X |
| 5,291,717 | 3/1994 | Turner | 52/745.07 |
| 5,590,493 | 1/1997 | Wilson | 52/108 |

*Primary Examiner*—Carl D. Friedman
*Assistant Examiner*—Yvonne M. Horton
*Attorney, Agent, or Firm*—Beyer & Weaver, LLP

[57] ABSTRACT

A method and apparatus for framing and supporting curved wall structures including a leg member attached to a web member to form a basic frame support assembly. The web member includes a mounting surface which terminates at a curvilinear edge, while the leg member includes spaced-apart notches which collectively define multiple tab portions. The tab portions are bent such that they are skewed relative to a remaining support portion of the leg member. The support portion of the leg member is conformed to the curvature of a curvilinear edge of the web member, and the tab portions are fastened to the mounting surface of the web member. This process can be repeated for additional leg members at additional curvilinear edges that may be present on the web member. In another aspect of the invention, elongated frame members, which serve as support studs, may be attached to the basic frame support assembly. Flexible wall members can be attached to the frame support, and the entire structure can be mounted to an independent supporting structure.

40 Claims, 4 Drawing Sheets

FRAME SUPPORT ASSEMBLY AND METHOD FOR CURVED WALLS

TECHNICAL FIELD

This present invention relates, generally, to wall supporting structures, and, more particularly, relates to frame support structures for curved walls.

BACKGROUND ART

Unlike relatively planar or angular-shaped walls for building structures, curvilinear-shaped walls such as radiused or serpentine walls, soffits or curtain walls are generally more difficult to construct. Mispositioning of a single vertically oriented stud may disrupt the smooth curvilinear continuity of the flex board or dry wall seated against the studs. Accordingly, preformed upper and/or lower framing tracks for curvilinear walls are often employed which mount to the respective ceiling and/or floor to facilitate proper spacing and positioning of the vertically oriented studs frames along the curvilinear path.

As shown in FIG. 1, an upper frame track 10 is adapted to mount to the ceiling structure (not shown). Once the frame track is properly mounted to the ceiling structure, a plurality of downwardly depending vertical studs 11 may be mounted thereto with fasteners 12. The flex board or flexible dry wall (not shown) is then supportively positioned atop the vertical studs.

Frame tracks 10 typically include a substantially planar web member 13 having opposed, curvilinear side edges 15, 15' which are usually parallel to one another. These curvilinear side edges 15, 15' are usually fabricated to substantially conform to the desired curvature of the radiused wall. Depending downwardly (or depending upwardly for a lower frame track) from the curvilinear side edges 15, 15', respectively, are opposed leg members 16 and 16', which are formed to provide vertical mounting support for the studs. The leg members 16, 16' are then collectively fastened to the web member in an edge-to edge manner through a plurality of tack welds 17.

One problem associated with these frame track arrangements is that they often require customized, prefabricated construction and assembly. Due to the curved nature of the components, precision on-site fabrication is difficult to achieve. For example, the web member 13 and the opposed leg members 16, 16' are typically composed of ten (10) to twenty (20) gauge steel. For example, each leg member 16, 16' must be manually manipulated to substantially conform to the curvature of a respective curvilinear side edge 15, 15' of the web member 13, and then be positioned edge-to-edge at about a 90° angle with the web member. As mentioned, the leg members are subsequently fastened to the respective curvilinear side edge 15, 15' through multiple spaced-apart tack welds 17. Difficulties thus occur during fabrication when attempting to align and weld a respective curved edge 18, 18' of the respective leg member 16, 16' with the respective curved side edge 15, 15' of the web member 13. Such alignment and securement is often laborious, substantially escalating fabrication costs and lengthening fabrication times, which are typically on the order of about two to four weeks.

Another problem associated with these designs is that the support strength of vertical studs 11 may be constrained by the collective load bearing strength of the tack welds 17 affixing the leg members 16, 16' to the web member 13. This is especially problemsome for radiused soffits or curtain walls which are essentially suspended from the ceiling.

Since the vertical studs 11 are often fastened directly to the leg members through bolt fasteners 12, as shown in FIG. 1, substantial vertical loads may ultimately impact the load bearing integrity of the tack welds. Hence, there is an ongoing need for an improved assembly and method for attaching a curved wall to an independent supporting structure.

SUMMARY OF THE INVENTION

In accordance with the present invention, an apparatus and method are provided for constructing a frame support adapted to mount a curved wall structure to an independent supporting structure. The constructing method includes the steps of: a) providing an elongated web member defining a mounting surface terminating at a first curvilinear edge thereof; and b) providing a bendable, elongated first leg member having a plurality of spaced-apart notches extending inwardly from a longitudinal edge thereof. These notches collectively define a plurality of side-by-side tab portions positioned along the longitudinal edge. The method further includes the steps of: c) bending a plurality of the tab portions to a position skewed relative to a remaining support portion of the first leg member such that a generally continuous crease is formed between the tab portions and the support portion; and d) conforming the support portion substantially to the curvature of the first curvilinear edge. Selected tab portions are then fastened to the mounting surface of the web member.

In one aspect, the method of the present invention further includes the step of positioning the first leg member substantially adjacent to the first curvilinear edge of the web member. This step is further performed by adjusting the first leg member such that the support portion is skewed relative to the mounting surface of the web member.

In another embodiment, the method includes the step of placing the continuous crease substantially adjacent to the first curvilinear edge of the web member. The conforming step may include the step of conformably bending the support portion to substantially conform to the curvature of the first curvilinear edge. Another aspect of the present inventive method may further include the step of mounting a plurality of elongated frame members of the curved wall to the frame support in a spaced-apart manner longitudinally therealong. This mounting step may be performed by fastening a respective tab portion to a distal end of a respective frame member.

Another method of the present invention is provided for mounting a curved wall to an independent supporting structure supporting the curved wall which includes the steps of: a) providing an elongated web member adapted to mount to the independent supporting structure and defining a mounting surface terminating at a curvilinear edge thereof; and b) providing a bendable, elongated leg member having a plurality of spaced-apart notches extending inwardly from a longitudinal edge. Similarly, the notches collectively define a plurality of side-by-side tab portions positioned along the longitudinal edge. The method subsequently includes the step of c) bending a plurality of the tab portions to a position skewed relative to a remaining support portion of the leg member. A generally continuous crease is formed between the bent tab portions and the support portion. The present inventive method then includes the steps of d) conforming the support portion substantially to the curvature of the curvilinear edge, and e) fastening a plurality of selected tab portions to the mounting surface of the web member while the support portion is positioned substantially adjacent to the curvilinear edge of the web member. Finally, the method includes the steps of f) mounting each of a plurality of elongated frame members of the curved wall to at least one of the web member and the leg member in a spaced-apart manner longitudinally therealong and g) mounting at least one wall member to selected elongated frame members.

In yet another aspect of the present invention, a frame support apparatus for a curved wall structure is provided including an elongated web member and an elongated bendable leg member. The web member provides a mounting surface which terminates at a curvilinear edge, while the leg member defines a plurality of spaced apart notches which extend inwardly from one longitudinal edge thereof. Collectively, these notches define a plurality of side-by-side tab portions positioned along the longitudinal edge each of which is preferably bent to a position skewed relative to a remaining support portion of the leg member. A generally continuous crease is thus formed between the tab portions and the support portion. In this configuration, the support portion of the leg member is then manipulated to substantially conform to the curvature of the curvilinear edge of the web member. Once the support portion is conformed to the curvilinear edge and the leg member is positioned sufficiently adjacent the web member, some or all of the selected tab portions are affixed to the web member for securement thereto.

In one embodiment of the present invention, a plurality of elongated frame members are mounted to the support portion of the leg member in a downwardly depending manner. These elongated frame members extend away from the web member and facilitate the attachment of wall members to the frame. The web member of the frame support is also adapted to mount to a supporting structure. Thus, the entire frame and wall structure, including the frame support, and the elongated frame members are mounted to the supporting structure.

BRIEF DESCRIPTION OF THE DRAWINGS

The assembly of the present invention has other objects and features of advantage which will be more readily apparent from the following description of the best mode of carrying out the invention and the appended claims, when taken in conjunction with the accompanying drawing, in which:

DETAILED DESCRIPTION OF THE INVENTION

Figure 1:
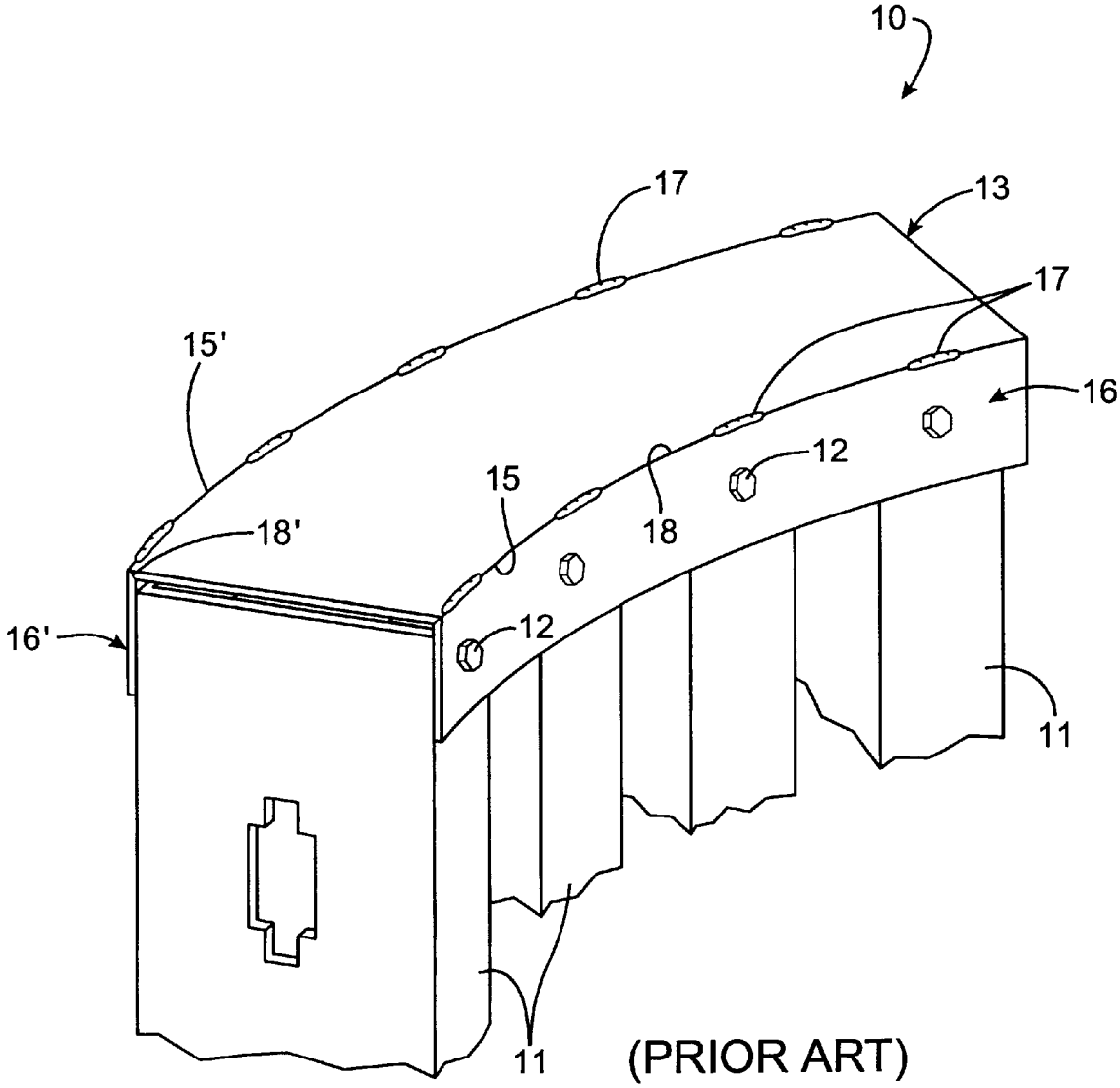
(PRIOR ART) FIG. 1
FIG. 1 is a fragmentary, top perspective view of a prior art frame support assembly for a curved wall.

While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims. It will be noted here that for a better understanding, like components are designated by like reference numerals throughout the various figures.

1. Brief Overview

Figure 2B:
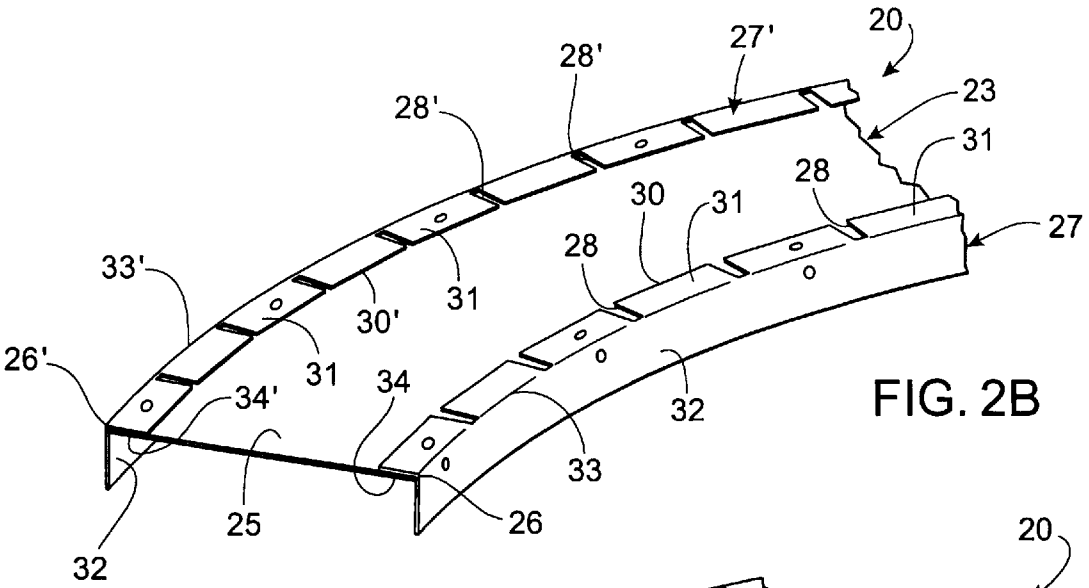
FIGS. 2A and 2B are a sequence of fragmentary top perspective views of a frame support assembly constructed in accordance with the present invention and during partial assembly.
Figure 2A:
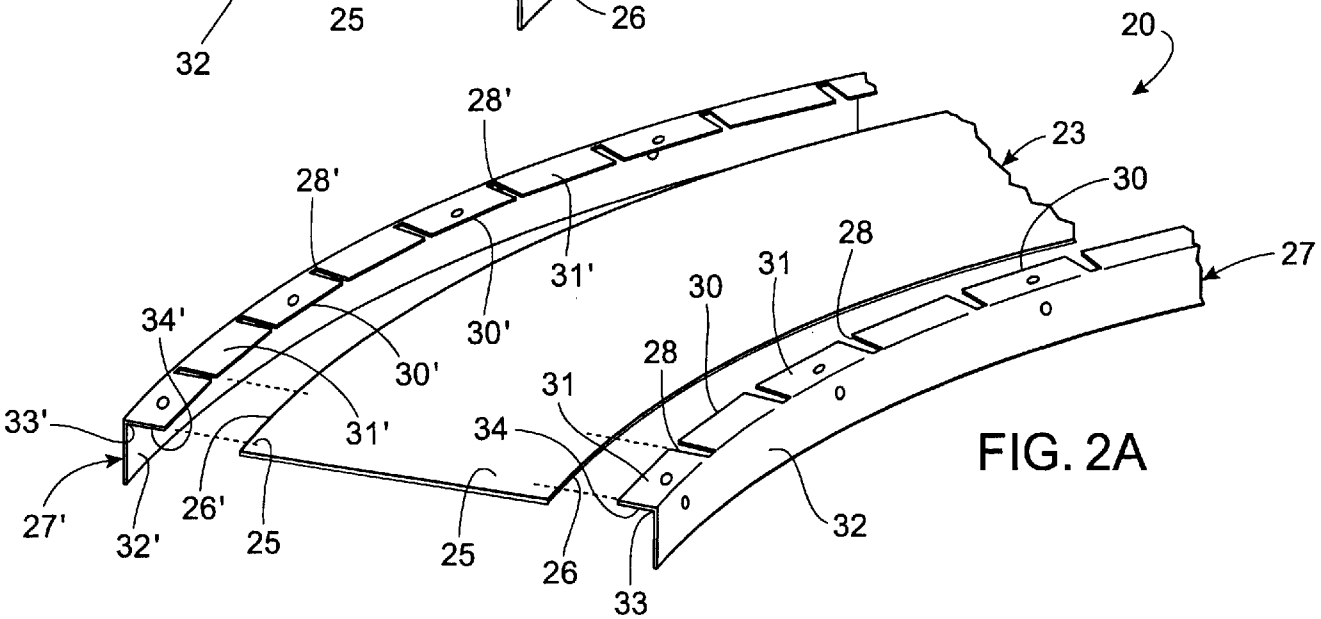
Figure 3:
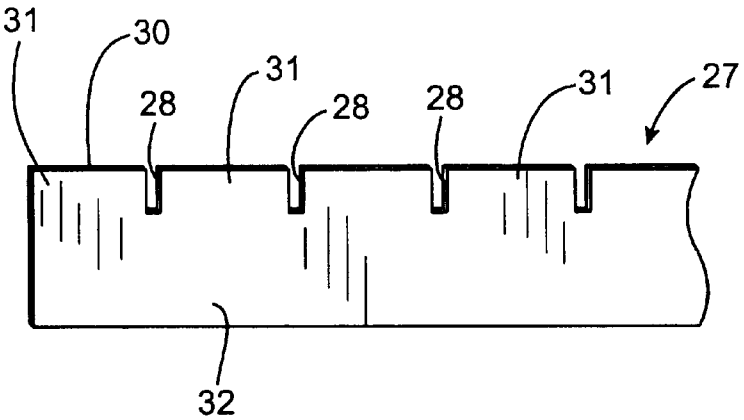
FIG. 3 is an enlarged fragmentary side elevation view of a leg member of the frame support assembly of FIG. 2 illustrating a plurality of spaced-apart notches collectively defining a plurality of tab portions thereof.
Figure 4:
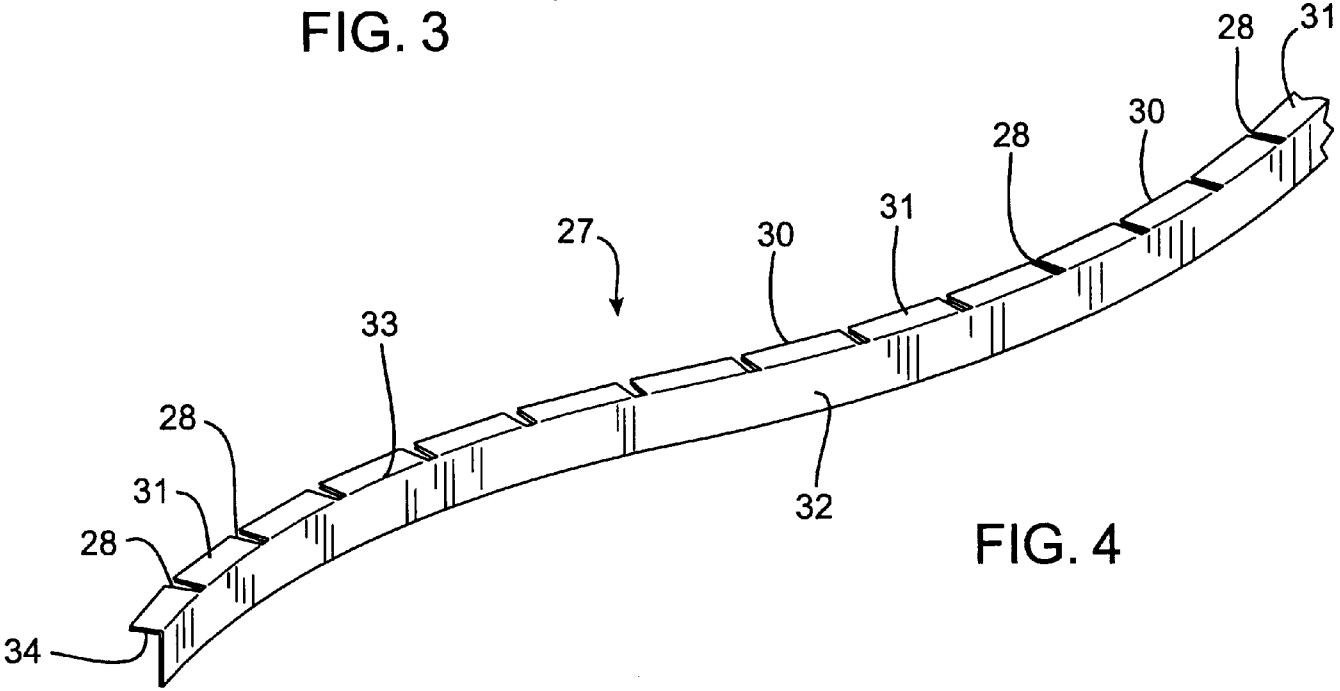
FIG. 4 is a fragmentary side elevation view of the leg member of FIG. 3 after bending of the tab portions to an affixing position.
Figure 5:
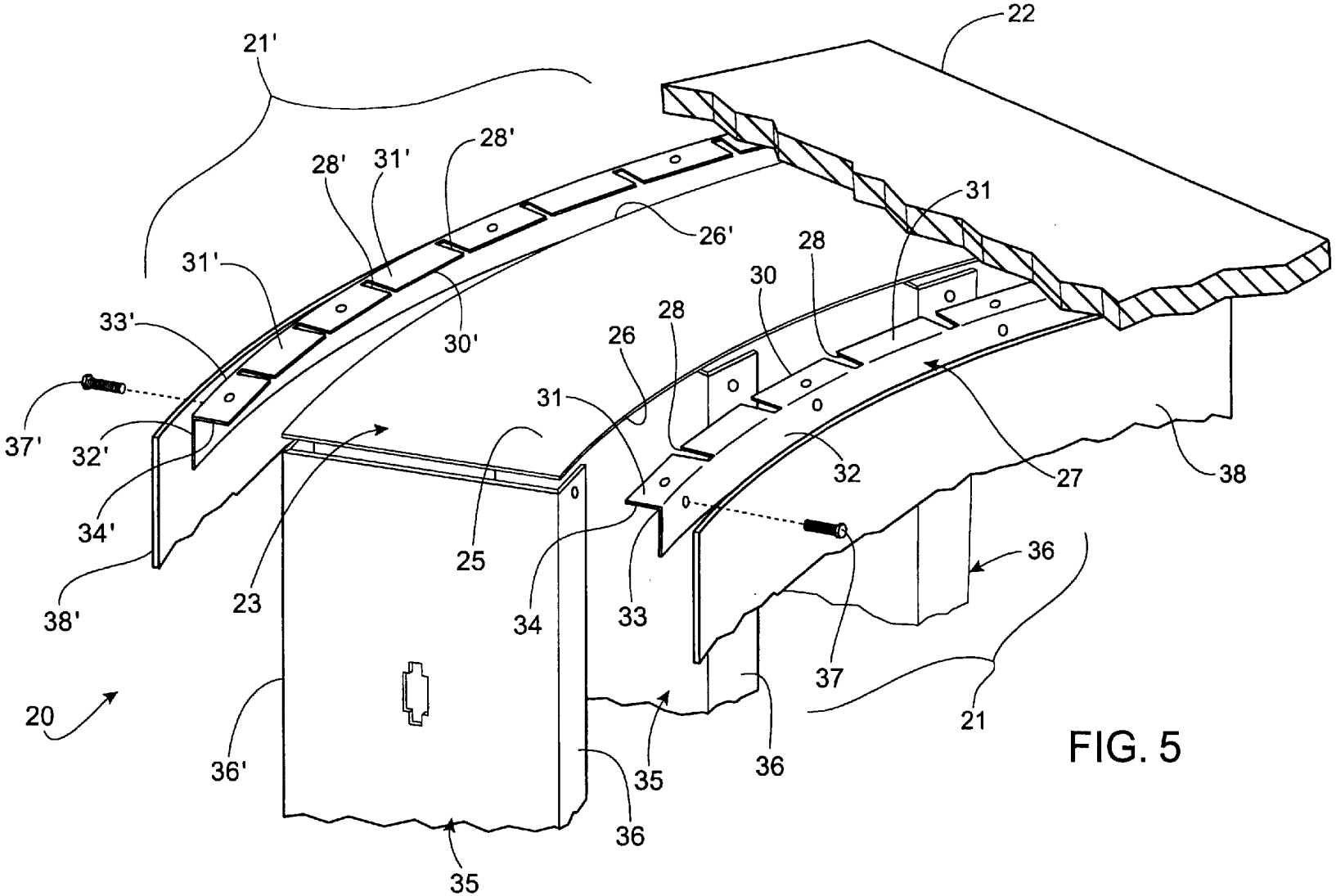
FIG. 5 is an enlarged, exploded, fragmentary top perspective view of a frame support assembly of the present invention and illustrating supportive mounting of elongated vertical frame members thereto.

Referring now to FIGS. 2–5, the present inventive method and apparatus are provided for constructing a frame support assembly, generally designated 20, adapted to mount a curved wall structure 21 (FIG. 5) to an independent supporting structure 22. The constructing method includes the steps of: a) providing an elongated web member 23 defining a mounting surface 25 terminating at a first curvilinear edge 26 thereof; and b) providing a bendable, elongated first leg member 27 having a plurality of spaced-apart notches 28 extending inwardly from a longitudinal edge 30 thereof. These notches 28 collectively define a plurality of side-by-side tab portions 31 positioned along the longitudinal edge 30, as shown in FIG. 3. The method further includes the step of: c) bending a plurality of the tab portions 31 to a position skewed relative to a remaining support portion 32 of the first leg member 27 such that a generally continuous crease 33 is formed between the tab portions 31 and the support portion 32 (FIG. 4). Referring now to FIG. 5, the present inventive method includes the steps of d) conforming the support portion 32 substantially to the curvature of the first curvilinear edge 26, and e) fastening selected tab portions 31 to the mounting surface 25 of the web member 23.

Accordingly, a frame support assembly is provided to facilitate construction of a radiused or serpentine wall, or a soffit or curtain wall in a building structure. Typically, this frame assembly will be affixed to a support structure, such as a ceiling structure or a floor structure to provide mounting stability to the curvilinear wall. In one aspect of the present invention, the bendable leg members are more easily and accurately conformed to the curved profile of the first curvilinear edge of the web member for fastening thereto. Moreover, the plurality of skewed tab portions provide a significant improvement in vertical load bearing strength when mounted to the mounting surface of the web member as compared to the tack welded components of the prior art frame assemblies.

Another advantage of the present invention is that the frame support assembly is substantially easier to fabricate which may reduce fabrication time and associated costs. Still another benefit is that by fastening the tab portions to a mounting surface rather than a narrow curvilinear edge, a considerably greater amount of support is provided to the leg member. In addition, because the leg member has tab portions that are bent beyond the curvilinear edge of the web member, and are preferably interdisposed between the web member and an independent supporting structure, ultimate frame failure is less likely.

While the present invention, for the most part, will be described in detail with reference to only one side of the present invention (e.g., the first leg member and the corresponding elongated studs), it will be appreciated that the present invention may include an opposed second leg member 27' formed to support an opposed curved wall without departing from the true spirit and nature of the present invention. This is especially suitable when the frame support assembly is employed as a curved retaining wall or the like. Moreover, the present invention frame support will be generally described in reference to a ceiling structure mounting. It will however be understood that the present invention may just as easily apply to any other supporting structure, such as a floor structure mounting as well.

2. Physical Embodiment

In accordance with the present invention and as shown in FIGS. 2 and 5, frame support assembly 20 includes an elongated web member 23 and a first elongated bendable leg member 27. The web member 23 provides a mounting surface 25 configured to terminate at a first curvilinear edge 26. As best illustrated in FIG. 3, leg member 27 provides a plurality of spaced apart notches 28 which extend inwardly from one longitudinal edge 30 thereof. Collectively, these notches 28 define a plurality of side-by-side tab portions 31 positioned along the longitudinal edge 30. Preferably, each of these notches is bent to a position skewed relative to a remaining support portion 32 of the first leg member 27. FIG. 4 illustrates that tab portions 31 are manipulated in a manner forming a generally continuous crease 33 between the tab portions 31 and the support portion 32 and extending from one distal end to the opposing distal end thereof. This configuration enables the support portion 32 of the leg member 27 to be easily manipulated to substantially conform to the curvature of the first curvilinear edge 26 of the web member 23 while retaining supportive contact of the tab portions 31 against the mounting surface 25 of the web member. Once the support portion is conformed to the first curvilinear edge 26 and the first leg member 27 is positioned sufficiently adjacent the web member 23, some or all of the selected tab portions 31 may be affixed to the mounting surface 25 of the web member for securement thereto.

The web member 23 is preferably provided by a relatively thin planar sheet having two opposed planar surfaces. Preferably, the web member is provided by stock sheet metal having a thickness of between about ten (10) gauge to about twenty (20) gauge. Depending upon the mounting configuration of the leg members, the mounting surface 25 is usually integrally positioned on the top planar surface of the web member 23 (i.e., for the ceiling structure). As detailed below, it will be apparent that the mounting surface 25 may be integrally positioned on the lower planar surface as well.

In accordance with the present invention, the first curvilinear edge 26 preferably corresponds substantially to the designed curvature of the curvilinear wall structure once assembled. Thus, the perimetric profile of the first curvilinear edge 26 may generally be any size and is generally one of elliptical, serpentine, parabolic, etc. For most practical purposes, however, the radius of curvature of the curvilinear edge should not be less than about a four (4) to eight (8) in radius, and more preferably a six (6) inch radius, to enable the support portion 32 to accommodate the curvature. Moreover, the web member may include a second curvilinear edge 26' positioned opposite the first curvilinear edge 26. As set forth above, this second curvilinear edge 26' is adapted to cooperate with a second leg member 27' to form a second curvilinear wall structure 21 ' positioned opposite the first curvilinear wall structure 21.

Referring now to FIGS. 3 and 4, the leg member 27 is illustrated having a plurality of spaced-apart notches 28 extending inwardly from a longitudinal edge 30 thereof. These notches 28 collectively define a plurality of side-by-side tab portions 31 positioned along the longitudinal edge which are utilized to mount the leg member to the web member (FIGS. 2 and 5). As best viewed in FIGS. 3 and 4, notches 28 may be positioned along the entire length of the longitudinal edge 30, and preferably extend substantially perpendicular to the longitudinal edge.

Employing a conventional break machine, or simply manually bending each tab portion to a skewed position relative the remaining support portion 32, a generally continuous crease 33 (FIG. 4) is thus formed between the bent tab portions 31 and the support portion 32. As will be described in greater detail below, continuous crease 33 functions as a dividing line between the bendable support portion 32 and the positioning of the skewed tab portions 31 for supportive contact against the mounting surface 25 of the web member.

Preferably, the continuous crease 33 is formed at the distal end of each notch 28 so that upon formation, the distal end of the notch will not form any part of the support portion 32. It will be noted that this positioning of the crease relative the notch enables formation of the tab portions 31 having the maximum depth for contact against the web mounting surface 25. Such a crease position, however, is not required for the collective formation of the tab portions 31. For instance, the height of the support portion 32 may be increased, and the depth of the tab portion may be decreased, by forming the crease 33 at a position closer to the longitudinal edge 30 of the leg member 27. In contrast, the height and depth dimensions of the support portion 32 and tab portions 31, respectively, may also be addressed by altering the longitudinal length of the corresponding notches.

Each notch 28 is of a width sufficient to enable substantial curvilinear bending of the support portion 32 without experiencing interference between the adjacent tab portions 31 when manipulated in a concave manner. This concept is clearly illustrated in FIG. 5 where the adjacent tab portions 31' of the second leg member 27' do not interfere with one another. Accordingly, the width of each notch is preferably in the range of at least about 3% to about 5% of the tab portion width. Moreover, while each notch 28 is preferably rectangular-shaped in illustration, the shape thereof may be triangular in a manner tapering outwardly toward the longitudinal edge of the second leg member. This configuration will facilitate non-interference between the adjacent tab portions 31 in more severe concave radiused walls. It will further be appreciated that by increasing the density of the notches (i.e., by decreasing the spacing between the adjacent notches, which in turn decreases the length dimension of each tab portion 31), smaller radiused curvilinear edges can be negotiated.

The first leg member 27 is preferably substantially the same length dimension as the corresponding first curvilinear edge 26 of the web member. Moreover, the composition of the leg member is preferably metallic in nature and of a like thickness to the web member as well. One favorable property of metallic materials is their deformation characteristics which, for instance, retain their rigidity, strength and load bearing properties after being bent. This is an advantage in that the angle at which the tab portions are bent can be readily adjusted. Another advantage is that metallic materials are easily amenable to welding as a method for fastening. It should be appreciated, however, that other suitable materials may be applied such as fiberglass, thermoplastics or the like.

In accordance with the present invention, the tab portions 31 are manipulated, relative the support portion 32, from the substantially planar, aligned position of FIG. 3 to the skewed position of FIG. 4. Preferably, the tab portions are skewed at about a 90° angle relative the support portions. Accordingly, when the support portion 32 is bent into curvilinear conformance with the first curvilinear edge 26, the support portion 32 will downwardly depend substantially perpendicular to the web mounting surface 25.

Each tab portion 31 includes a substantially planar contact surface 34 adapted to supportably seat against the substantially planar mounting surface 25 of the web member 23. By positioning the substantially continuous crease 33 in alignment with and substantially adjacent to the first curvilinear edge 26 of the web member 23, support portion 32 conforms to the first curvilinear edge 26. Subsequently, the contact surfaces 34 of the tab portions 31 may be fastened to the mounting surface 25 of the web member 23. Fasteners, such as rivets or bolts, may be employed to secure the selected tab portions to the web member. Preferably, however, such fastening is provided by spot welding, adhesives or the like since the top surface (preferably mounting surface 25) of the frame support assembly 20 is likely to be positioned flush against the ceiling structure 22 (FIG. 5). Another configuration to strengthen the structure and to mount the same to ceiling structure 22 would be to position a fastener (not shown) through the bottomside of web member 23 through a tab portion 31 and into the ceiling structure 22.

In the preferred embodiment, the tab portions 31 are to be positioned atop the web member 23 (e.g., for the ceiling frame support assembly) to maximize load bearing contact of the tab portions 31 against the web member 23. The contact surface 34 of each tab portion 31 is thus positioned at an underside surface thereof and preferably terminates at the continuous crease when properly aligned. In this arrangement, during assembly, the contact surfaces 33 of the corresponding tab portions 31 may be slideably supported atop the mounting surface 25 in a manner seating the first curvilinear edge in abutting contact with the continuous crease 33. This assures proper curvilinear alignment to substantially conform the support portion 32 with the corresponding curvilinear edge 26. Moreover, such seating of the curvilinear edge 26 in the crease maximizes the load bearing portion of each contact surface 34.

Accordingly, once the respective tab portions 31 are coupled to the corresponding upward facing mounting surface 25 of the web member 23, the downward vertical loads communicated to the support portion 32 by the elongated frame members 35 will be dispersed to the web member. This is particularly advantageous since the resulting configuration is substantially strengthened.

It will be appreciated, however, that the contact surface 34 may be oriented on the upside surface of each tab portion 31 (not shown). Applying this embodiment, the upward facing contact surfaces are adapted to seat against the downward facing mounting surface (i.e., the underside surface) of the web member 23. While this arrangement may be adequate in some instances, the vertical load bearing capabilities may not be as significant as the previous embodiment.

Briefly, as shown in FIGS. 2 and 5, the second leg member 27' may be mounted to the corresponding mounting surface 25' of the web member 23 in a similar manner. By positioning an interior portion of continuous crease 33' in seated contact with the second curvilinear edge 26', the corresponding contact surfaces 33 may be fastened to the web member mounting surface 25. Thus, two opposed leg members 27, 27' extend downwardly from the web member 23 to secure the elongated frame members 35 therebetween. It will be appreciated that while the opposed leg members 27, 27' are illustrated substantially parallel or concentric one another, non-parallel orientations can be accommodated as well.

In one embodiment of the present invention, as best illustrated in FIG. 5, a plurality of elongated frame members 35 are mounted between the opposed support portions 32, 32' in a downwardly depending manner, and extend laterally from the first leg member 27 to the opposite second leg member 27'. These metallic U-shaped studs are preferably unitary structures mounted to the frame support assembly 20 at upper portions thereof. More specifically, the opposing side portions 36, 36' of the elongated frame members 35 are affixed to the corresponding support portions 32, 32' of the leg members through fasteners 37, 37'.

For instance, in a complete radiused wall, the elongated frame members would extend from the ceiling structure 22 all the way to the floor structure (not shown). A corresponding lower frame support assembly (not shown) would be affixed to the floor structure, which in turn would mount the lower portions of the elongated frame members to the same. Consequently, the radiused or serpentine wall would be securely affixed to both the floor structure and the ceiling structure through the lower frame support assembly and the upper frame support assembly, respectively. For a curved soffit or curtain wall, in contrast, the lower distal end of the elongated frame members are suspended from the upper frame support assembly.

In another embodiment of the present invention, the elongated frame members may be mounted directly to the web member (not shown) through fasteners or the like. For instance, in this arrangement, the fasteners may jointly extend through both the tab portions and web member and into the elongated frame member. Moreover, this mounting configuration may be especially suitable when the elongated frame members are composed of wooden studs or the like since the fasteners could then extend directly into the distal ends of the studs.

Finally, flex boards or dry wall 38, 38' can be mounted to the elongated frame members 35 or the support portions 32, 32' of the respective leg member 27, 27' for vertical support thereagainst. These flexible boards can be conformed to the curvature of the support portion and the elongated frame members to complete the curvilinear wall structures.

It should also be noted that the present invention is not restricted to curved walls, but may be applicable straight walls as well, or even a combination thereof. Since the curvilinear edges of the illustrated web member are opposed and concentric, web member 23 and both leg members 27, 27' combine to form a basic frame support assembly for a simple radiused wall. Other components, curved wall members for example, can be added to this basic frame to form a complete structure.

3. Process Details

A preferred method of the present invention will now be described for constructing a frame support assembly 20 adapted to mount a curved wall structure 21 to an independent supporting structure 22 is provided, as viewed in FIGS. 2–5, including the steps: a) providing an elongated web member 23 defining a mounting surface 25 which terminates at a first curvilinear edge 26 thereof (FIG. 2A); and b) providing a bendable, elongated first leg member 27 having a plurality of spaced-apart notches 28 extending inwardly from a longitudinal edge 30 thereof (FIG. 3). The present inventive method further includes the step of: c) bending a plurality of the tab portions 31 to a position skewed relative to a remaining support portion 32 of the first leg member 27 such that a generally continuous crease 33 is formed between the tab portions 31 and the support portion 32 (FIG. 4). The next step includes d) conforming the support portion 32 substantially to the curvature of the first curvilinear edge 26 (FIG. 2B), while the step e) includes fastening a plurality of selected tab portions 31 to the mounting surface 25 of the web member 23 (FIG. 5). This fastening step may include the step of welding the selected tab portions 31 to the mounting surface 25 of the web member 23.

After the conforming step d), the method may include the step of positioning the first leg member 27 substantially adjacent to the first curvilinear edge 26 of the web member so that the leg member 27 may be aligned with the web member 23 (FIG. 2B). This positioning step is further performed by placing the continuous crease 33 substantially adjacent to the first curvilinear edge 26 of the web member 23. The positioning step may also be performed by positioning the continuous crease 33 substantially against the first curvilinear edge 26 of the web member 23. This positioning step may also include the step of sliding the contact surface 34 of the tab portions 31 against the mounting surface 25 until the curvilinear edge is received in the continuous crease 33.

In another embodiment, the method includes the step of adjusting the first leg member 27 such that the support portion 32 is skewed relative to the mounting surface 25 of the web member 23. The conforming step d) may include the step of conformably bending the support portion 32 to substantially conform to the curvature of the first curvilinear edge 26 (FIG. 2A).

Referring back to FIGS. 2A and 2B, the inventive method of the present invention further includes the steps of: defining a second curvilinear edge 26' of the longitudinally extending opposite the first curvilinear edge 26, providing a bendable, elongated, second leg member 27' having a plurality of spaced-apart notches 28' extending inwardly from a respective longitudinal edge 30 ' thereof which collectively define a plurality of side-by-side second tab portions 31' positioned along the second leg member longitudinal edge 30'. The next step includes bending a plurality of the second tab portions 31' to a position skewed relative to a remaining second support portion 32' of the second leg member 27' such that a generally continuous second crease 33' is formed between the second bent tab portions 31' and the second support portion 32'. Similar to the first support portion 32, the method includes the step of conforming the second support portion 32' substantially to the curvature of the second curvilinear edge 26; and fastening a plurality of selected second tab portions 31' to a mounting surface 25 of the web member 23 while the second support portion 32' is positioned substantially adjacent to the second curvilinear edge 26' of the web member 23'.

In another aspect of the present invention, the method may further include the step of mounting a plurality of elongated frame members 35 to the frame support assembly 20 in a spaced-apart manner longitudinally therealong. This mounting step may be performed by fastening a respective tab portion 31, 31 ' to a distal end of a respective frame member. This mounting step may also be performed by fastening a respective support portion 32, 32' to opposed side portions of the respective frame member 35.

An alternative method of the present invention is now described for mounting a curved wall structure 21 to an independent supporting structure 22 supporting the curved wall which includes the steps of: a) providing an elongated web member 23 adapted to mount to the independent supporting structure 22 and defining a mounting surface 25 which terminates at a curvilinear edge 26 thereof; and b) providing a bendable, elongated leg member 27 having a plurality of spaced-apart notches 28 extending inwardly from a longitudinal edge 30. Similarly, the notches 28 collectively define a plurality of side-by-side tab portions 31 positioned along the longitudinal edge 30. The next step includes c) bending a plurality of the tab portions 31 to a position skewed relative to a remaining support portion 32 of the leg member 27. A generally continuous crease 33 is formed between the bent tab portions and the support portion 32. The method of the present invention then includes the steps of d) conforming the support portion 32 substantially to the curvature of the curvilinear edge 26, and e) fastening a plurality of selected tab portions 31 to the mounting surface 25 of the web member 23 while the support portion 32 is positioned substantially adjacent to the curvilinear edge 26 of the web member 23. Finally, the next steps include f) mounting each of a plurality of elongated frame members 35 of the curved wall structure 21 to at least one of the web member 23 and the leg member 27 in a spaced-apart manner longitudinally therealong and g) mounting at least one flexible wall member 38 to selected elongated frame members 35.

Frequent reference has been made to a simple radiused or serpentine wall, or a soffit or curtain wall with concentrically curved edges and walls. Although the drawings depict a simple curvilinear wall, it should be appreciated that the method or components of the present invention can be used in a wide variety of different orientations and configurations as well. Therefore, the present examples are to be considered as illustrative and not restrictive, and the invention is not to be limited to the details given herein, but may be modified within the scope of the appended claims.

What is claimed is:

1. A method for constructing a frame support adapted to mount a curved wall structure to a support structure comprising the steps of:

a) providing an independent elongated web member defining a substantially planar mounting surface terminating at a first curvilinear edge portion thereof;

b) providing an independent, bendable, elongated first leg member having a plurality of spaced-apart notches extending inwardly from a longitudinal edge portion thereof which collectively define a plurality of side-by-side tab portions positioned along said longitudinal edge portion;

c) bending a plurality of said tab portions to a position skewed relative to a remaining support portion of said first leg member such that a generally continuous crease is formed between said tab portions and said support portion;

d) conforming said support portion substantially to the curvature of said first curvilinear edge portion;

e) placing the tab portions adjacent to and in mounting contact with the substantially planar mounting surface; and f) fastening a plurality of selected tab portions to said mounting surface of said web member.

2. The method as recited in claim 1 further including the step of:

after the conforming step, positioning said first leg member substantially adjacent to said first curvilinear edge of said web member.

3. The method as recited in claim 2 further including the step of, placing said first leg member substantially adjacent to said first curved edge portion such that said support portion is skewed relative to said mounting surface of said web member.

4. The method as recited in claim 1 further including the step of:

positioning said continuous crease substantially adjacent to said first curvilinear edge portion of said web member.

5. The method as recited in claim 4 further including the step of:

before said positioning step, placing said first leg member adjacent to said first curved edge portion such that said support portion is skewed relative to said mounting surface.

6. The method as recited in claim 1 wherein, said bent tab portions are bent at an angle of about 90° relative to said support portion.

7. The method as recited in claim 1 wherein, each said bent tab portion defines a substantially planar contact surface adapted to seat against said mounting surface.

8. The method as recited in claim 4 wherein, each said contact surface of each said bent tab portion terminates at an interior portion of said continuous crease.

9. The method as recited in claim 8 further including the step of:

positioning said continuous crease substantially against said first curvilinear edge portion of said web member.

10. The method as recited in claim 1 further including the step of:

mounting a plurality of elongated frame members of said curved wall to said frame support in a spaced-apart manner longitudinally therealong.

11. The method as recited in claim 10 wherein, said mounting step includes the step of fastening a respective tab portion to a distal end of a respective frame member.

12. The method as recited in claim 11 wherein, said mounting surface of said web member is further adapted to mount to said support structure.

13. The method as recited in claim 1 wherein, said notches are substantially linear and extend inwardly substantially perpendicular to said longitudinal edge portion of the web member.

14. The method as recited in claim 1 wherein, said fastening step includes the step of welding said selected tab portions to said mounting surface of said web member.

15. The method as recited in claim 1 wherein, said elongated web member further defining a second curvilinear edge portion longitudinally extending opposite the first curvilinear edge portion, and said method further including the steps of:

providing a bendable, elongated, second leg member having a plurality of spaced-apart notches extending inwardly from a respective longitudinal edge thereof which collectively define a plurality of side-by-side second tab portions positioned along the second leg member longitudinal edge;

bending a plurality of said second tab portions to a position skewed relative to a remaining second support portion of said second leg member such that a generally continuous second crease is formed between the second bent tab portions and said second support portion;

conforming said second support portion substantially to the curvature of said second curvilinear edge portion; and fastening a plurality of selected second tab portions to a mounting surface of said web member while said second support portion is positioned substantially adjacent to said second curvilinear edge portion of said web member.

16. The method as recited in claim 15 wherein, said second curvilinear edge portion is oriented substantially opposite said first curvilinear edge portion such that said first and second curvilinear edge portions are substantially concentric one another.

17. The method as recited in claim 15 further including the step of:

mounting a plurality of elongated frame members of said curved wall to said frame support in a spaced-apart manner longitudinally therealong.

18. A method for mounting a curved wall to a supporting structure to support the curved wall comprising the steps of:

a) providing an independent elongated web member adapted to mount to the support structure and defining a substantially planar mounting surface terminating at a curvilinear edge portion thereof;

b) providing an independent, bendable, elongated leg member having a plurality of spaced-apart notches extending inwardly from a longitudinal edge thereof which collectively define a plurality of side-by-side tab portions positioned along said longitudinal edge portion;

c) bending a plurality of said tab portions to a position skewed relative to a remaining support portion of said leg member such that a generally continuous crease is formed between the bent tab portions and said support portion;

d) conforming said support portion substantially to the curvature of said curvilinear edge portion;

e) fastening a plurality of selected tab portions to said mounting surface of said web member while said support portion is positioned substantially adjacent to said curvilinear edge portion of said web member;

f) mounting each of a plurality of elongated frame members of said curved wall to at least one of the web member and the leg member in a spaced-apart manner longitudinally therealong such that said frame members extend away from the support structure; and g) mounting at least one flexible wall member to selected elongated frame members.

19. The method as recited in claim 18 wherein, said mounting step further includes the step of:

conforming said wall member substantially to the curvature of said support portion of said leg member.

20. The method as recited in claim 18 further including the step of:

affixing the web member to the support structure.

21. A method for constructing a frame support adapted to mount a curved wall structure to a support structure comprising the steps of:

a) providing an elongated web member defining a mounting surface terminating at a first curvilinear edge portion thereof;

b) providing a bendable, elongated first leg member having a plurality of spaced-apart notches extending inwardly from a longitudinal edge portion thereof which collectively define a plurality of side-by-side tab portions positioned along said longitudinal edge portion;

c) bending a plurality of said tab portions to a position skewed relative to a remaining support portion of said first leg member such that a generally continuous crease is formed between said tab portions and said support portion;

d) conforming said support portion substantially to the curvature of said first curvilinear edge portion; and e) welding a plurality of selected tab portions to said mounting surface of said web member.

22. The method as recited in claim 21 further including the step of:

after the conforming step, positioning said first leg member substantially adjacent to said first curvilinear edge of said web member.

23. The method as recited in claim 21 wherein, said bent tab portions are bent at an angle of about 90° relative to said support portion.

24. The method as recited in claim 21 further including the step of:

mounting a plurality of elongated frame members of said curved wall to said frame support in a spaced-apart manner longitudinally therealong.

25. The method as recited in claim 24 wherein, said mounting step includes the step of fastening a respective tab portion to a distal end of a respective frame member.

26. The method as recited in claim 21 wherein, said welding is provided by spot welding.

27. A method for constructing a frame support adapted to mount a curved wall structure to a support structure comprising the steps of:

a) providing an elongated web member defining a mounting surface terminating at a first curvilinear edge portion on one side thereof, and terminating at a second curvilinear edge portion on an opposite side thereof b) providing a bendable, elongated first leg member and a second leg member each having a plurality of spaced-apart notches extending inwardly from respective longitudinal edge portions thereof, and each of which collectively define a plurality of respective side-by-side tab portions positioned along the respective longitudinal edge portion;

c) bending a plurality of tab portions of the first leg member and the second leg member to positions skewed relative to the respective remaining support portions thereof such that a respective generally continuous crease is formed between the tab portions and the respective support portion;

d) conforming the respective support portions substantially to the respective curvature of the first and second curvilinear edge portions; and e) fastening a plurality of selected tab portions of the first leg member and the second leg member to said mounting surface of said web member.

28. The method as recited in claim 27 wherein, the curvilinear edge portions are oriented substantially opposite and parallel one another.

29. The method as recited in claim 27 further including the step of:

mounting a plurality of elongated frame members of said curved wall to said frame support in a spaced-apart manner longitudinally therealong.

30. A frame support assembly adapted to mount a curved wall structure to a support structure comprising:

an independent elongated web member defining a substantially planar mounting surface terminating at a first curvilinear edge portion thereof;

an independent, bendable, elongated first leg member having a plurality of spaced-apart notches extending inwardly from a longitudinal edge portion thereof which collectively define a plurality of side-by-side tab portions positioned along said longitudinal edge portion, said tab portions being adapted for bending to a position skewed relative to a remaining support portion of said first leg member such that a generally continuous crease is formed between said tab portions and said support portion, said support portion being substantially conformed to the curvature of said first curvilinear edge portion such that the tab portions are adjacent to and in mounting contact with the substantially planar mounting surface; and a plurality of fasteners adapted to fasten selected tab portions to said mounting surface of said web member.

31. The frame support assembly as defined in claim 30, wherein said tab portions are positioned atop said mounting surface of said web member such that said support portion is downwardly skewed relative thereto.

32. The frame support assembly as defined in claim 31, wherein said continuous crease of said first leg member is configured for receipt of said first curvilinear edge portion of said web member therein.

33. The frame support assembly as defined in claim 32 wherein said bent tab portions are bent at an angle of about 90° relative to said support portion.

34. The frame support assembly as defined in claim 30, further including:

a plurality of elongated frame members mounted to said support portion in a spaced-apart manner longitudinally therealong.

35. The frame support assembly as defined in claim 30, wherein said notches are substantially linear and extend inwardly substantially perpendicular to said longitudinal edge portion of the web member.

36. The frame support assembly as defined in claim 30, wherein said fasteners are provided by welding.

37. The frame support assembly as defined in claim 36, wherein said welding include spot welds.

38. The frame support assembly as defined in claim 30, wherein said independent elongated web member further defines a second curvilinear edge portion longitudinally extending opposite the first curvilinear edge portion, and said support assembly further including:

an independent, bendable, elongated second leg member having a plurality of spaced-apart notches extending inwardly from a second longitudinal edge portion thereof which collectively define a plurality of side-by-side second tab portions positioned along said second longitudinal edge portion, said second tab portions being adapted for bending to a position skewed relative to a remaining second support portion of said second leg member such that a generally continuous second crease is formed between said second tab portions and said second support portion, said second support portion being substantially conformed to the curvature of said second curvilinear edge portion such that the second tab portions are adjacent to and in supportive contact with the substantially planar mounting surface; and a plurality of second fasteners adapted to fasten selected second tab portions to said mounting surface of said web member.

39. The frame support assembly as defined in claim 38, wherein said second curvilinear edge portion is oriented substantially opposite said first curvilinear edge portion such that said first and second curvilinear edge portions are substantially concentric one another.

40. The frame support assembly as defined in claim 39, further including:

a plurality of elongated frame members mounted between the respective support portions of the first and second leg members in a spaced-apart manner longitudinally therealong.

* * * * *